US005873568A

United States Patent [19]

Mayfield

[11] Patent Number: 5,873,568

[45] Date of Patent: Feb. 23, 1999

[54] GUTTER HOLDING PLIERS

[76] Inventor: Roy M. Mayfield, 3144 Westlock Cir., Decatur, Ga. 30038

[21] Appl. No.: 971,700

[22] Filed: Nov. 17, 1997

[51] Int. Cl.[6] ..... B25B 1/20

[52] U.S. Cl. ..... 269/41; 269/3; 269/6

[58] Field of Search ..... 269/41, 3, 87.2, 269/96, 170, 6, 127, 904, 275, 43; 81/420, 421, 424.5, 423, 426.5

[56] References Cited

U.S. PATENT DOCUMENTS

| | | | |
|---|---|---|---|
| 2,766,649 | 10/1956 | Labry | 269/274 X |
| 5,240,234 | 8/1993 | Lee | 269/43 |
| 5,575,518 | 11/1996 | Payne | 269/41 X |

*Primary Examiner*—James G. Smith
*Assistant Examiner*—Sinclair Skinner
*Attorney, Agent, or Firm*—Harry I. Leon; Vivian L. Steadman

[57] ABSTRACT

A tool for supporting a rain gutter during its installation on a fascia board. The tool has a height-adjustable bracket and locking pliers with jaws having wide, flat working faces. Once several such tools are temporarily locked onto the lower edge of the fascia board, not only can they be used to support an elongated gutter but also each of the tools can be moved vertically without disturbing the pliers clamping it to the board, thereby making these tools especially handy for setting the height and slope of the gutter. For holding the adjustable bracket in position, each tool includes a mounting block which is rigidly attached to the back of a fixed jaw of the locking pliers and defines a pair of holes which extend parallel to the plane of the working face of the fixed jaw. The bracket is formed from an elongated rod bent to form an angular structure which terminates in a pair of parallel branches slideably insertable into the holes formed in the block. Locking the branches in position within the mounting holes is accomplished with the use of a pair of threadedly engaged screws. The angular structure is padded by either a coating of a soft plastic material or plastic or rubber tubing to protect the surface finish of the gutter. In use, the uninstalled gutter is rested on an array of these tools clamped to the fascia board. A proper slope for the gutter is attained by adjusting the height of the bracket in each of the tools and then verifying that proper drainage will occur in gutter. When the slope is satisfactory, the gutter is fastened onto the fascia board in the usual manner. Then each of the supporting tools is removed.

8 Claims, 3 Drawing Sheets

GUTTER HOLDING PLIERS

BACKGROUND OF THE INVENTION

This invention relates to a device for temporarily holding a gutter in place during its installation. Gutters typically come in standard lengths of 10, 20 and 40 feet. Fabricated of a thin wall material which is usually aluminum or plastic in composition, they are easily bent during shipment, handling or installation. In a typical installing job, several men are needed to support a gutter during its installation.

Lee, in U.S. Pat. No. 5,240,234, realized the importance of having a temporary holder to facilitate installation of a rain gutter. Lee's holder uses spring-closing pliers to clamp onto the fascia board of a building. Although Lee's invention is an aid in the installation of a gutter, it has two problems in use. The first is that the pliers must be repositioned on the facia board with each adjustment in the placement of the gutter relative thereto. Not only does this activity consume time and entail extra work in opening the pliers against the force of the spring but also it can cause additional damage to the surface finish of the fascia board. Further, Lee's holder is so constructed that part of the pliers is clamped on the fascia board between the gutter and this board; and, as a consequence, the holder has to be removed before installation of the gutter can be completed.

Midlik, in U.S. Pat. No. 4,579,303, discloses a gutter jack which is fastened to the lower edge of the fascia board with screws during the installation of a gutter. Midlik's jack allows one to adjust the height of the gutter easily. However, Midlik's jack has two problems. The first is that the support for his jack is attached to the fascia board with screws; and the second is that, similarly to Lee's holder, the support for Midlik's jack is held between the fascia board and the gutter and has to be removed prior to completing installation of the gutter.

SUMMARY OF THE INVENTION

The object of this invention is to provide a low cost tool that allows one man to install a rain gutter on a building.

A further object of the invention is to provide such a tool with which the height of the rain gutter can be adjusted during installation.

A further object of the invention is to provide such a tool which does minimum damage to the finish of the fascia board on the building during use.

A further object of the invention is to provide such a tool which can be utilized when only a very short piece of fascia board edge is exposed, with approximately ⅛ inch of edge being enough for holding the tool in contact with the board.

A further object of the invention is to provide such a tool which is so constructed that it only has to be removed after completion of installation of the rain gutter.

A further object of the invention is to provide a tool which can be used not only to support the gutter during installation but also to aid in straightening out any bends or dents in the gutter that may have occurred during and prior to its installation.

In accordance with the present invention, a tool, known as gutter holding pliers, comprises an attachment for locking pliers having smooth, wide jaws, with one of the jaws being fixed in position relative to the other. The attachment includes a block rigidly fastened to the back of the fixed jaw and a bracket which is removably attached to the block. In use, the bracket is mounted on the block in such a way that the bracket extends in a direction away from the jaws, so that the pliers can be used to straighten out any bends or dents that may have been formed in the gutter during and prior to its installation.

Means for removably attaching the bracket to the block comprises the block having two mounting holes bored therein which extend longitudinally generally parallel to the working face of the fixed jaw and to each other. The bracket is fabricated from an elongated rod bent to form a centrally-disposed retaining member with an inverted "U" shape and a pair of parallel arms, each of which terminates in a branch. Each arm and the branch connected thereto lie generally in a plane which is disposed parallel to the plane in which the other arm and its branch are generally situated. The two arms extend perpendicularly to the plane of the "U" from the distal ends thereof, and the two branches extend perpendicularly to the arms and in a direction away from the retaining member.

In the assembled tool, the two branches are slidably inserted into the mounting holes and held there by a pair of screws threadably engageable with the block, each screw intersecting one of the mounting holes. Means for adjusting the height of the arms relative to the block includes these screws which, in the preferred embodiment, are thumb screws.

Preferably, the bracket is coated with a soft plastic material so as to form padding between the rod and surface areas in contact with the finish of the gutter. Alternately, a plastic or rubber tubing can be slipped over the rod to protect the finish.

In use, the parallel arms form a temporary support upon which to rest the gutter when the jaws of the pliers are clamped to the lower part of the fascia board. The height of the gutter can be adjusted while the jaws of the pliers are so clamped by simply loosening the screws holding the branches of the bracket in place, sliding them within the mounting holes until the arms have reached a desired height, and then tightening the screws.

The procedure for using this tool is to fasten a series of such tools on the lower part of an existing facia board at about 5 foot intervals. The uninstalled gutter is then rested on these tools. The slope of the gutter is set by adjusting the height of the parallel supporting arms on each of the tools. By using a level or just placing some water in the gutter, a check can be made to determine whether the gutter will drain properly. When the gutter is considered to be properly positioned, one fastens it onto the fascia board in the usual manner. Once the gutter is securely fastened, then each of the tools is removed from the fascia board.

DESCRIPTION OF THE PREFERRED EMBODIMENT

Figure 1:
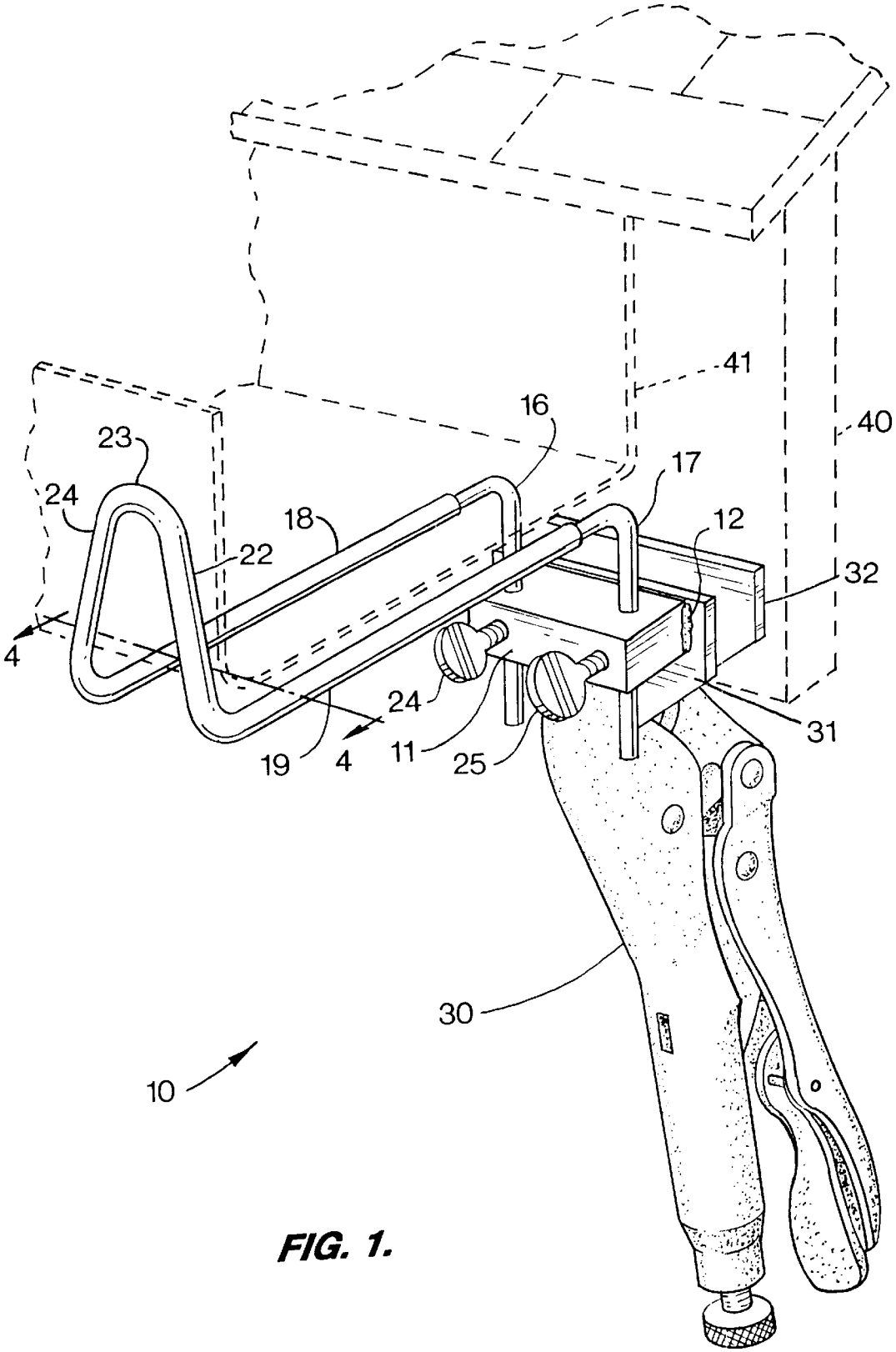
FIG. 1 is a right side perspective view of the tool according to the present invention, the tool being shown removably attached to a fascia board and supporting a rain gutter, fragmentary parts of both the board and gutter being illustrated by long dashed lines.
Figure 2:
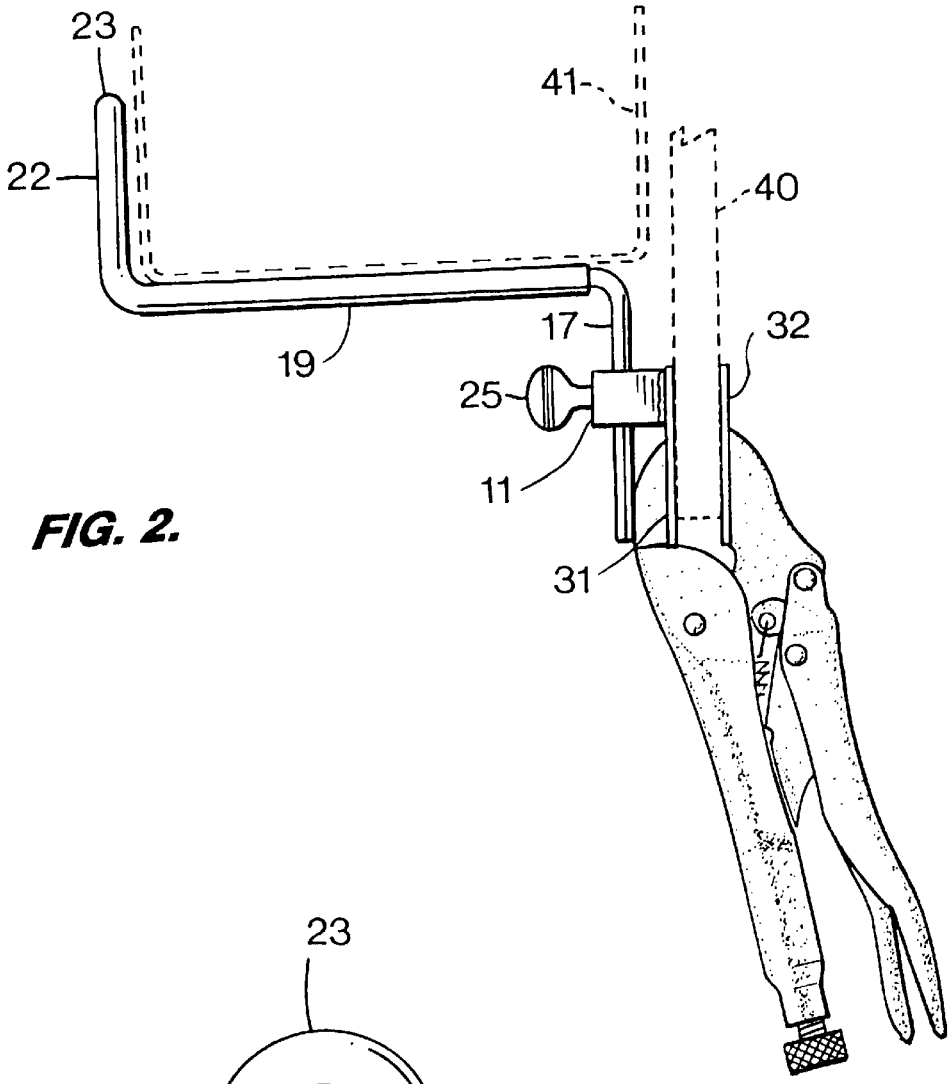
FIG. 2 is a side view of the tool according to FIG. 1 which has been clamped to a fascia board and is supporting a gutter.
Figure 4:
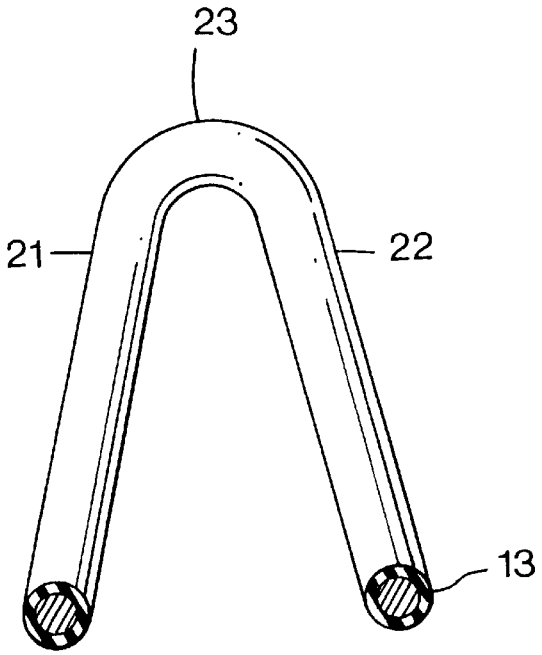
FIG. 4 is a cross-sectional view taken along line 4—4 of FIG. 1.

In the present invention, a tool denoted generally by the reference numeral 10 includes an attachment to wide jaw locking pliers 30 with flat working faces. This attachment comprises a block 11 and a bracket 20 having a pair of arms 18, 19 which terminate in branches 16, 17, respectively.

Rigidly fastened to the back of fixed jaw 31 of the pliers 30, the block 11 is preferably joined to the jaw 31 by a weld 12 (FIG. 1). Alternately, flat head screws or the like can be used which, in assembled relation, engage threaded holes aligned with each other in both the fixed jaw and the block, each screw head being seated in a countersunk hole formed in the jaw.

Figure 3:
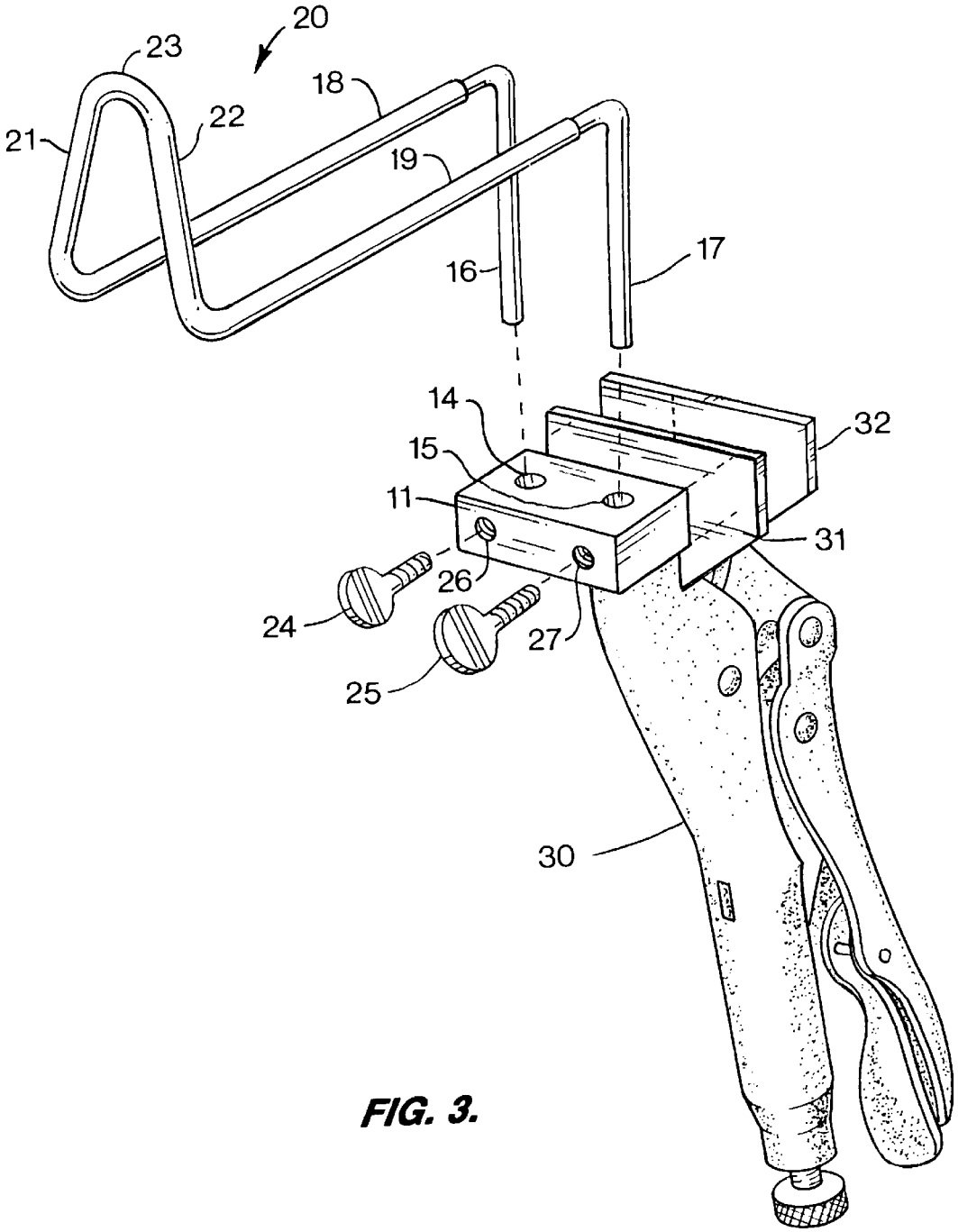
FIG. 3 is a exploded perspective view of the tool according to FIG. 1.

Fabricated from an elongated metal rod which measures, by way of example, about ¼ inch in diameter, the bracket 20 includes a retaining member which defines an inverted "U" shape having an apex 23 and elements 21, 22 which extend downwardly therefrom (FIGS. 1 and 3). Forming an integral part of the bracket 20 with the retaining member are the arms 18, 19 which extend perpendicularly from the distal ends of the elements 21, 22 and are disposed generally parallel to each other. Each of the arms 18, 19 terminates in a downwardly extending branch 16, 17, respectively, and with this branch lies in a plane which is disposed generally parallel to the plane in which the other arm and its branch are situated. In the preferred embodiment, each arm 18, 19 measures, by way of example, about 8 inches in length; and each branch 16, 17 is about 4 inches long.

As shown in FIG. 3, the block 11 defines two holes 14, 15 which are bored longitudinally generally parallel to the working face of the fixed jaw 31 and to each other. The holes 14, 15 are sized so that the branches 16, 17 can be slideably received therein. The block 11 further defines a pair of threaded holes 26, 27 which are disposed perpendicularly to the holes 14, 15, respectively, and which intersect them. In the preferred embodiment, two thumb screws 24, 25 which are threadedly engageable with the holes 26, 27 are used to hold the branches 16, 17 in place and to adjust their position relative to the block 11.

In the preferred embodiment, a soft coating 13 of plastic or the like is applied to the retaining member and the arms 18, 19 so as to form padding for protecting the finish of any gutter 41 in contact therewith (FIGS. 1–4). Preferably, this coating 13 is bonded to the rod from which the bracket 20 is fabricated. Alternately, a plastic or rubber tubing can be slipped over the retaining member and arms to protect this finish. In addition, a soft coating of plastic or the like is preferably bonded to the working faces of the jaws 31, 32 for further protect it.

In use, several of the tools 10 are clamped onto the lower edge of a fascia board 40 and spaced apart from each other, typically at intervals of about 5 feet. The tools 10 then form temporary support stations for an elongated conventional rain gutter 41. The uninstalled gutter 41, as it rests on the arms 18, 19 of each tool, is prevented from sliding off laterally by the retaining members of the brackets 20. At each station, the height of the supporting arms 18, 19 can be adjusted to get a desired slope for the rain gutter. Specifically, the thumb screws 24, 25 can be loosened and then retightened to allow one to vary the extent to which each pair of branches 16, 17 is inserted into contiguous holes 14, 15. Generally, the clamping action of the pliers 30, once set, need not be disturbed until the slope of the gutter 41 has been properly set. The latter condition can be determined by using a level or just by placing some water in the gutter 41 to check whether it has proper drainage. After the gutter 41 is in proper position, the gutter is permanently fastened onto the fascia board 40 in the usual manner; and only later need the tools 10 be removed. Importantly, with the use of the tool 10, a single person can easily install a gutter 41; without the tool, at least two people would normally be needed to install such a gutter.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A tool for temporarily supporting a rain gutter during its installation on a fascia board, comprising:

(a) locking pliers with wide jaws which can be clamped onto the fascia board, the pliers including a fixed jaw with a generally planar working face;

(b) a mounting block rigidly attached to the fixed jaw, the block defining at least one mounting hole which extends longitudinally generally parallel to the working face of the fixed jaw;

(c) a structure for supporting the gutter, a portion of the structure being is slideably inserted into the hole in the mounting block; and (d) means for locking the structure in a desired vertical position relative to the mounting block.

2. The tool according to claim 1 wherein the means for locking the structure in a desired position comprises a thumb screw, the mounting block defining at least one opening which extends perpendicularly to the mounting hole and intersects it, the thumb screw being threadedly engaged with said opening.

3. The tool according to claim 2 wherein the structure further comprises a soft plastic coating, the coating being so disposed that finish on each portion of the rain gutter resting on the tool and in contact with the structure is protected.

4. The tool according to claim 1 wherein the structure extends upwardly and away from the working face of the fixed jaw, so that the rain gutter can be permanently secured to the fascia board while the tool is still clamped thereto.

5. A device to facilitate installation of a rain gutter on a fascia board, comprising:

(a) locking pliers having wide jaws with generally planar working faces which can be temporarily attached to the fascia board;

(b) a block rigidly attached to one of the jaws of the pliers;

(c) a support structure upon which the gutter can rest during its installation, the structure being connected to the block and slidably movable in a direction generally parallel to the working face of the jaw to which the block is attached; and (d) means for holding the support structure at a desired height relative to the block while the pliers are still attached to the fascia board.

6. The device according to claim 5 wherein the support structure extends upwardly and away from the working face of the jaw to which the structure is attached, so that the rain gutter can be permanently secured to the fascia board while the tool is still clamped thereto.

7. The device according to claim 5 wherein the support structure further comprises a soft plastic coating, the coating being so disposed that finish on each portion of the rain gutter resting on the device and in contact with the structure is protected.

8. The device according to claim 5 wherein the jaws of the pliers are coated with a soft plastic material, so that damage to the fascia board can be prevented when the pliers are attached thereto.

* * * * *